United States Patent [19]

Wilson et al.

[11] 4,001,956

[45] Jan. 11, 1977

[54] TRACTOR SCRAPER TRANSPORTATION AND ASSEMBLY THEREFOR

[75] Inventors: Eugene M. Wilson; William T. Girard, both of Joliet, Ill.

[73] Assignee: Caterpillar Tractor Co., Peoria, Ill.

[22] Filed: Sept. 17, 1975

[21] Appl. No.: 614,052

[52] U.S. Cl. ..... 37/129; 172/245; 280/460 R

[51] Int. Cl.[2] ..... E02F 3/62

[58] Field of Search ..... 37/124–129, 37/8, DIG. 13, 195; 172/780, 245; 280/456 R, 460 R, 415 R, 492, 400–401, 467, 478 R, 495, 497

[56] References Cited

UNITED STATES PATENTS

| | | | |
|---|---|---|---|
| 2,495,336 | 1/1950 | LeTourneau | 37/129 |
| 2,854,768 | 10/1958 | Gurries | 37/126 R |
| 3,015,173 | 2/1962 | Kimsey et al. | 37/129 |
| 3,657,830 | 4/1972 | Hamilton | 37/129 |
| 3,893,250 | 7/1975 | Hamilton | 37/129 |

*Primary Examiner*—E. M. Eickholt
*Attorney, Agent, or Firm*—Phillips, Moore, Weissenberger, Lempio & Strabala

[57] ABSTRACT

The invention is concerned with a transported tractor scraper of the type having a scraper bowl connected to a tractor. The transported tractor scraper comprises a laterally extending draft tube disposed longitudinally between said tractor and said scraper bowl. A pair of spacers are mounted interiorly on a respective sidewall of the scraper bowl. A pair of draft arms are detachably mounted at a first end thereof interiorly on one of the spacers a spaced distance away from a respective sidewall. A generally flat transport bracket is provided detachably interconnected between a second end of each of the draft arms and the draft tube. A method for transporting a tractor scraper of the type having a draft tube and a pair of draft arms interconnecting a scraper bowl to a tractor is disclosed. The method comprises removing the draft arms from the scraper bowl and the tractor; connecting spacers interiorly on each sidewall of the scraper bowl; connecting a first end of each draft arm to a respective spacer a spaced distance away from a respective sidewall; and attaching a second end of each draft arm to said draft tube.

13 Claims, 6 Drawing Figures

TRACTOR SCRAPER TRANSPORTATION AND ASSEMBLY THEREFOR

BACKGROUND OF THE INVENTION

1. Field of the Invention

Wheel-tractor scrapers pose a shipping problem when they are delivered to a job site or a customer on a railroad flat car or are driven on a public highway. In particular, the width and low operating profile of the scrapers require special shipping techniques to comply with certain governmental regulations. For example, U.S. Pat. No. 3,015,173 assigned to the assignee of this application, discloses the detachment and placing of the scrapers draft arms in the scraper bowl to reduce the width thereof for shipping purposes. In addition, such patent discloses the use of a bracket which is secured between a draft tube and the apron of the scraper bowl. Also, U.S. Pat. No. 3,893,250, assigned to the assignee of this application, discloses the detaching of the scrapers draft arms from the exterior of the sidewalls of the scraper bowl, the attachment of said draft arms interiorly of the sidewalls of the scraper bowl and attachment via a bracket to the ends of the draft arms which are not attached interiorly of the sidewalls of the scraper bowl to the draft tube of a tractor.

2. Summary of the Invention

An object of this invention is to provide an improved, economical and non-complex rigid transport assembly for tractor spacers and a method for efficiently using same. The transport assembly comprises of a generally flat bracket including longitudinally spaced first and second end portions integrally connected together in straight relationship by an intermediate portion. The assembly also includes spacer means mountable interiallly on a sidewall of a scraper bowl of a tractor scraper, a draft arm attachable at a first end thereof to said spacer means a spaced distance away from a respective sidewall of said scraper bowl, and mounting means formed at each of the first and second end portions of the bracket to respectively attach the bracket to a second end of the draft arm and to a draft tube of the tractor scraper.

A transported tractor scraper of the type having a scraper bowl connected to a tractor is also disclosed and claimed. The transported tractor scraper comprises a laterally extending draft tube longitudinally between the tractor and the scraper bowl. Spacer means are mounted interially on a respective sidewall of the scraper bowl. A pair of draft arms are provided each having a first end thereof detachably mounted interiorly on said spacer means a spaced distance away from a respective sidewall. A generally flat transport bracket is detachably interconnected between a second end of each of the draft arms and the draft tube.

A method for transporting a tractor scraper of the type having a draft tube and a pair of draft arms interconnecting a scraper bowl to a tractor is also disclosed and claimed. The method comprises removing the draft arms from the scraper bowl and the tractor, connecting spacers interiorly on each sidewall of the scraper bowl, interconnecting a first end of each draft arm to a respective spacer a spaced distance away from a respective sidewall, and attaching a second end of each draft arm to the draft tube.

BRIEF DESCRIPTION OF THE DRAWINGS

The invention will be better understood by reference to the figures of the drawings wherein like numbers denote like parts throughout and other objects of the invention will become apparent from the following description and the accompanying drawings, wherein.

DETAILED DESCRIPTION OF THE PREFERRED EMBODIMENT

Figure 1:
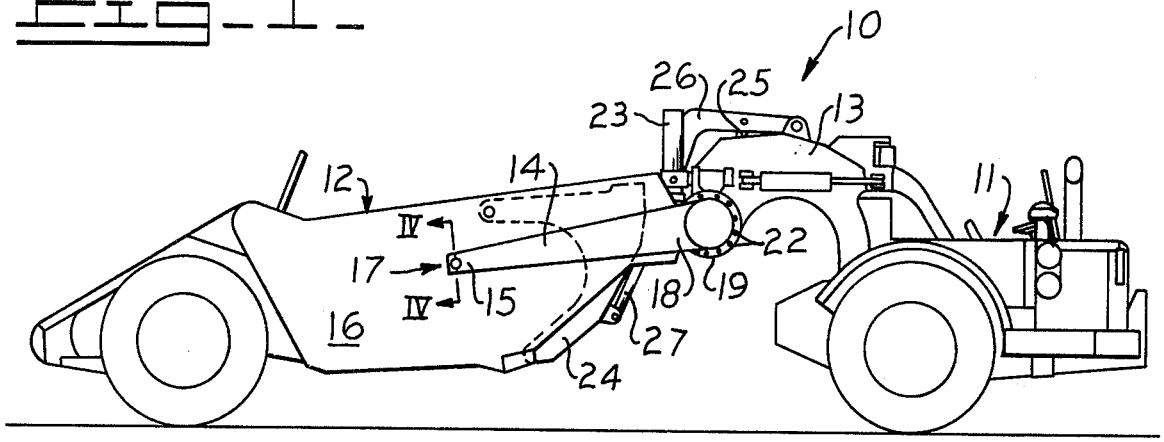
FIG. 1 illustrates in side elevational view a wheel-tractor scraper shown in its operating condition.
Figure 3:
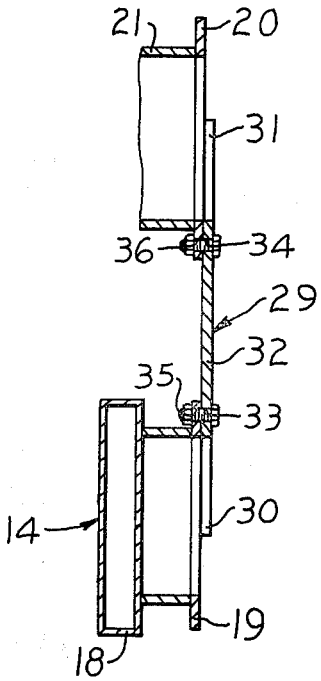
FIG. 3 is a view taken in the direction of the arrows III — III in FIG. 2.

FIG. 1 illustrates a wheel-tractor scraper 10 comprising a two-wheeled tractor 11 connected to a scraper bowl 12 by a gooseneck 13 and a pair of laterally spaced draft arms 14 one of which is illustrated. Each draft arm 14 has a first end 15 mounted exteriorly on a sidewall 16 of the scraper bowl 12 by a trunion assembly 17. A second end 18 of each draft arm carries an annular flange 19 attached to a like flange 20 (FIG. 3) of a laterally extending draft tube 21 by circumferentially disposed cap screws 22.

The wheeled-tractor scraper 10 further comprises a pair of lift cylinders 23, one of which is illustrated in FIG. 1, supported on the draft tube 21. The lift cylinders 23 function to selectively raise or lower the attached scraper bowl 12. An apron 24 is pivotally mounted within the scraper bowl 12 to selectively open or close the front (open) end thereof by means of a cylinder partially shown at 25, a lift frame 26 and a link 27.

Figure 2:
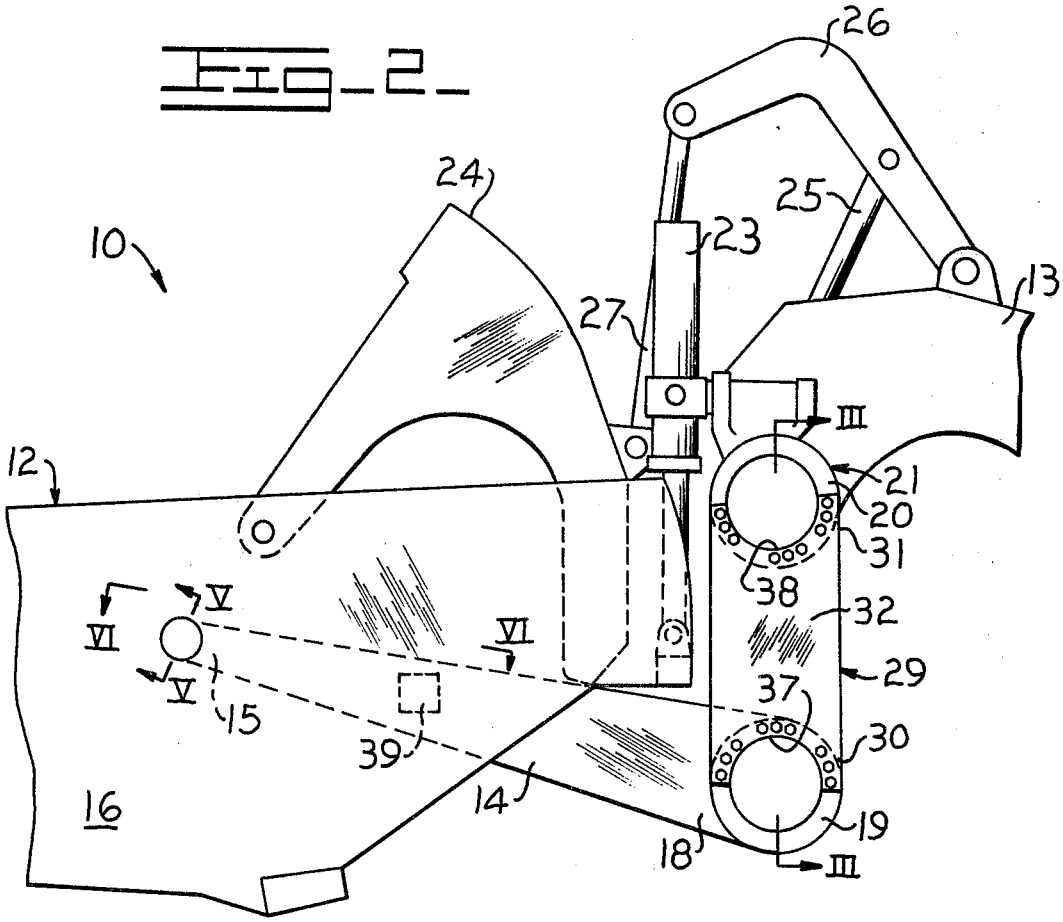
FIG. 2 is a partial view similar to FIG. 1, but showing the wheel-tractor scraper rearranged in a transport condition.
Figure 5:
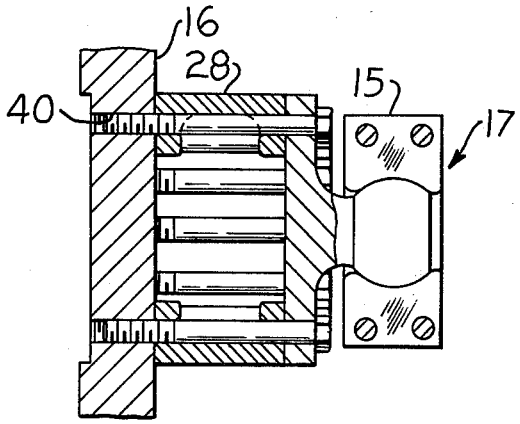
Figure 6:
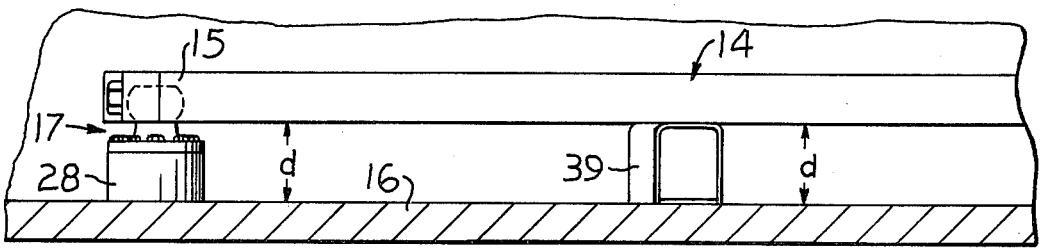

When it is desired to transport the wheeled-tractor scraper 10 to a remote location, such as by railroad flat car or by driving it on a public highway at a relatively high speed (e.g., 50 k.p.h.), workmen will proceed to rearrange the scraper 10 to its FIG. 2 transport condition. Firstly, apron 24 is raised above and later rested upon the draft arms 14 which are detached from the exterior of the scraper bowl 12 and the draft tube 21 by releasing trunion assemblies 17 and cap screws 22. Each draft arm is rotated 180° to have its first end 15 mounted interiorly on spacer means, in the embodiment illustrated a spacer 28. The spacer 28 is itself mounted as by a plurality of bolts interiorly on a respective sidewall 16, with trunion assembly 17, which is itself moved along with each draft arm 14 from the exterior of a sidewall 16 to the interior thereof, mounted to the spacer 28 and more particularly to a side of the spacer 28 spaced from the interior of the sidewall 16 (FIG. 5) whereby each draft arm 14 is a distance, *d*, from the interior of the sidewall 16.

The second end 18 of each draft arm 14 is connected to a lateral end of the draft tube 21 by a vertically disposed transport bracket 29. As more clearly shown in FIG. 3, the transport bracket 29 comprises longitudinally spaced first and second end portions 30 and 31, respectively, integrally connected together in straight relationship by an intermediate portion 32, the transport bracket 29 being thus generally flat. The first and second end portions 30 and 31 of the transport bracket 29 are substantially disposed in a single plane which is substantially coincident with the faces of the flanges 19 and 20 respectively. Thus, there is no need for providing an expensive bracket with off set (generally non-planer) end portions which might be subject to fatigue or even failure or might require expensive machining and/or welding to strengthen it between said end portion thereof. The end portions 30 and 31 of bracket 29 have mounting means formed therein, such as circumferentially disposed holes 33 and 34 which align with underlying holes 35 and 36, respectively, formed in flanges 19 and 20, respectively.

The cap screws 22 can thus be utilized to attach the ends 30 and 31 of the bracket 29 to the flanges 19 and 20. Semi-circular cut-out 37 and 38 may be formed on each end of the bracket 29 to provide guide means, conforming to an inner radius of flanges 19 and 20, to precisely align holes 33 with underlying holes 35 and holes 34 with underlying holes 36.

In the preferred embodiment of the invention bumper means, in the embodiment illustrated a bumper 39 is provided attached interiorly to a sidewall 16 of the wheel-tractor scraper 10. The bumper 39 is placed intermediate the ends 15 and 18 of the draft arm 14 and serves to prevent the scraper bowl 12 from shifting sideways relative to the draft arms 14 and to prevent the arms from rocking back and forth and contacting the interiors of the sidewalls 16. Thus, the bumpers 39 serve to protect the draft arms 14, the interior of the scraper 12, the bracket 29 and the bolts or the like connecting the draft arms 14 to the scraper 12 and to the bracket 29 from strain and resulting fatigue and possible failure. The bumpers 39 extend between the respective sidewall 16 and the respective one of the draft arms generally the spaced distance, *d*.

Figure 4:
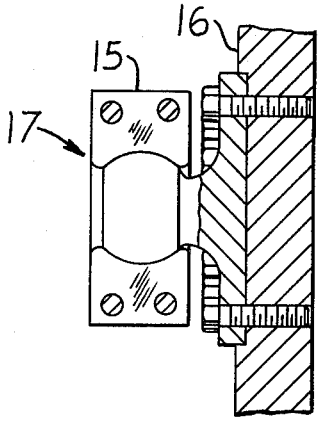
FIGS. 4, 5, and 6 are enlarged partial sectional views taken in the direction of arrows IV — IV in FIG. 1 and V — V and VI — VI in FIG. 2, respectively.

Upon transport of the wheeled-tractor scraper to its job site or the like, the above procedure may be reversed. In particular, the brackets 29 would be removed from the draft arms 14 and the draft tube 21 and the draft arms along with the trunion 17 would be reattached to the scraper 10 as shown in FIG. 1. As is more apparent from FIGS. 4 and 5 the same set of threaded bores 40 can be used to attach the spacer 28 to the interior of the sidewall 16 as are used to attach the trunion assembly 17 to the exterior thereof.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A transported tractor scraper of the type having a scraper bowl connected to a tractor, comprising:

1. A laterally extending draft tube disposed longitudinally between said tractor and said scraper bowl;
2. Spacer means mounted interiorly on respective sidewalls of said scraper bowl;
3. A pair of draft arms each having a first end thereof detachable mounted interiorly on said spacer means a spaced distance away from a respective sidewall; and
4. A generally flat transport bracket detachably interconnected between a second end of each of said draft arms and said draft tube.

2. A tractor scraper as in claim 1, wherein each of said draft arms has the first end thereof pivotally mounted interiorly to said spacer means.

3. A tractor scraper as in claim 1, wherein said transport brackets each extend vertically downwardly from said draft tube to the second end of a respective draft arm.

4. A tractor scraper as in claim 3, including bumper means mounted between each respective sidewall of said scraper bowl and each respective one of said draft arms intermediate the ends of said draft arms, said bumper means extending between the respective sidewall and the respective draft arm generally said spaced distance.

5. A tractor scraper as in claim 4, wherein said bumper means comprise a pair of bumpers each interiorly mounted to a respective sidewall and extending generally said spaced distance therefrom.

6. A tractor scraper as in claim 5, wherein each of said transport brackets comprises first and second end portion integrally connected together in straight relationship by an intermediate portion, said first end portion connected to an angular flange secured to a second end of a respective draft arm and said second end portion connected to an annular flange secured on a respective end of said draft tube.

7. A tractor scraper transport assembly, comprising;

1. A generally flat bracket including longitudinally spaced first and second end portion integrally connected together in straight relationship by an intermediate portion;
2. Spacer means mountable interiorly on an interior of a sidewall of a scraper bowl of a tractor scraper;
3. A draft arm attachable at a first end thereof to said spacer means a spaced distance away from a respective sidewall of said scraper bowl; and
4. Mounting means formed at each of the first and second end portion of said bracket to respectively attach said bracket to a second end of said draft arm and to a draft tube of said tractor scraper.

8. A transport assembly as in claim 7, wherein each of said mounting means comprises a plurality of holes formed to a respective end portion of said bracket and disposed in semi-circular relationship thereon.

9. A transport assembly as in claim 8, including a semi-circular cut-out formed through each of the first and second end portions of said bracket, a respective plurality of holes being circumferentially disposed about a respective one of said cut-out.

10. A transport assembly as in claim 9, including bumper means mounted between said sidewall and said draft arm and extending generally said spaced distance.

11. A transport assembly as in claim 10, wherein said bumper means comprises a bumper interiorly mounted to a respective sidewall and extending generally said spaced distance therefrom.

12. A method for transporting a tractor scraper of the type having a draft tube and a pair of draft arms interconnecting a scraper bowl to a tractor, comprising:

1. removing said draft arms from said scraper bowl and said tractor;
2. connecting a first end of each draft arm to a respective scraper a spaced distance away from a respective interior sidewall; and 3. interconnecting a generally flat bracket between a the second end of each of said draft arms and a respective end of said draft tube.

13. A method as in claim 12, including connecting bumpers interiorly on each sidewall of said scraper bowl, said bumpers extending said spaced distance away from a respective sidewall and being connected intermediate each sidewall and a respective draft arm.

* * * * *